US008777644B2

(12) United States Patent
Pai

(10) Patent No.: US 8,777,644 B2
(45) Date of Patent: Jul. 15, 2014

(54) PLUG WITH CONNECTING DEVICE

(75) Inventor: Jason Pai, New Taipei (TW)

(73) Assignee: Taiwan Linetek Electronc Co., Ltd., New Taipei (TW)

( * ) Notice: Subject to any disclaimer, the term of this patent is extended or adjusted under 35 U.S.C. 154(b) by 158 days.

(21) Appl. No.: 13/607,608

(22) Filed: Sep. 7, 2012

(65) Prior Publication Data

US 2014/0073153 A1 Mar. 13, 2014

(51) Int. Cl.
*H01R 13/44* (2006.01)

(52) U.S. Cl.
USPC ..... 439/131; 439/172

(58) Field of Classification Search
USPC ..... 439/131, 103, 104, 172
IPC ..... H01R 31/06,35/04, 27/00, 13/652
See application file for complete search history.

(56) References Cited

U.S. PATENT DOCUMENTS

| | | | | |
|---|---|---|---|---|
| 6,935,878 | B2 * | 8/2005 | Hsu et al. | 439/171 |
| 7,001,196 | B1 * | 2/2006 | Huang | 439/320 |
| 7,104,813 | B1 * | 9/2006 | Chuang | 439/131 |
| 7,481,660 | B1 * | 1/2009 | Tsai | 439/131 |
| 7,787,238 | B2 * | 8/2010 | Liao et al. | 361/679.01 |

* cited by examiner

*Primary Examiner* — Hien Vu
(74) *Attorney, Agent, or Firm* — Guice Patents PLLC

(57) ABSTRACT

The present invention relates to a plug with connecting device, which comprises a top housing having a connecting device extended at one side for being connected to a power adapter; two copper contact rings; a retaining seat; an electrode sheet base having a pivotal shaft; two electrode sheets; and a bottom housing engaged with the top housing; when the two electrode sheets are longitudinally rotated, the two electrode sheets are enable to be pivotally moved at the outside of the bottom housing, and the two electrode sheets are positioned when being latched in the first positioning slot, an electrical conducting state is formed between the electrode sheets and the connecting device so as to transfer electric power to a power adapter.

16 Claims, 11 Drawing Sheets

PLUG WITH CONNECTING DEVICE

BACKGROUND OF THE INVENTION

1. Field of the Invention

The present invention relates to a connector, more particularly to a plug with connecting device, one end thereof is connected to an AC power source through electrode sheets and the other end thereof is coupled to a power adapter through the connector, thereby being able to supply converted DC power to an electronic device.

2. Description of Related Art

A conventional plug often only has two electrode sheets for being connected to a socket for gaining AC power through the socket. There is another type of plug having foldable electrode sheets, the electrode sheets can be folded into the plug main body when not in use thereby preventing oxidation and danger caused by users' misuse, such as children.

As for the mentioned plugs, before shipped out of factory, the plug has often been connected with a cable. And another end of the cable has a matching socket relative to the plug, thereby being enabled to be connected to an electronic device, e.g. a computer, so AC power can be converted into DC power through a power supply device installed in the electronic device.

For a portable electronic device, e.g. a notebook computer or a digital camera, because of space limitation, a power adapter is often required for converting AC power into DC power so as to supply to the portable electronic device. Thus the described combination of plug and socket is not able to be connected to the power adapter and additional cost is occurred due to purchase the power adapter.

Based on what has been disclosed above, the present invention provides a plug with connecting device for improving the mentioned disadvantages.

SUMMARY OF THE INVENTION

One objective of the present invention is to provide a plug with connecting device, one end thereof is connected to an AC power source through electrode sheets and the other end thereof is coupled to a power adapter through the connector, so converted DC power is obtained and is able to be supplied to an electronic device.

Another objective of the present invention is to provide a plug with connecting device, electrode sheets thereof are able to be folded into a bottom housing of the plug thereby terminating the electrical connection to AC power source.

For achieving the aforementioned objectives, the present invention provides a plug with connecting device, which comprises: a top housing having a connecting device extended at one side for being connected to a power adapter, and the connecting device has plural ring-shaped slots; two copper contact rings, wherein one end of each of the copper contact rings is in a gradually-expanding shape and is respectively received in the ring-shaped slots of the connecting device, the other end thereof is respectively extended with a contact sheet; a retaining seat having a first retaining slot, the bottom of the first retaining slot is formed with a first positioning slot, the top of the first retaining slot is formed with a second positioning slot; an electrode sheet base having a pivotal shaft, one side of the pivotal shaft is formed with a positioning column, and one side of the pivotal shaft is received in the first retaining slot, two ends of the pivotal shaft are respectively installed with a switch seat, the switch seat is further formed with a seat hole, and the bottom of the seat hole is hollow; two electrode sheets, one end of each of the electrode sheets is formed with a stop sheet, the other end is formed with a wire hole, wherein the stop sheets are received in the seat holes and exposed outside the seat holes; and a bottom housing, able to be engaged with the top housing, having a hollow chamber for accommodating the retaining seat, a bottom housing surface is formed with two housing slots respectively allowing the two electrode sheets to be exposed, the bottom of the housing slot is hollow, and the end section is formed with a plane hole, a second retaining slot is formed between the two housing slots for receiving the other side of the pivotal shaft; after being assembled, when the two electrode sheets are longitudinally rotated, the two electrode sheets are enable to be pivotally moved at the outside of the bottom housing, and the two electrode sheets are positioned through the positioning column being latched in the first positioning slot, meanwhile the stop sheets of the two electrode sheets are in contact with the contact sheets, thereby electrically conducting the plural ring-shaped slots and the two electrode sheets.

For achieving aforementioned objectives, the present invention provides a plug with connecting device, which comprises: a top housing having a connecting device extended at one side for being connected to a power adapter, and the connecting device has plural ring-shaped slots; two copper contact rings, wherein one end of each of the copper contact rings is in a gradually-expanding shape and is respectively received in the ring-shaped slots of the connecting device, the other end thereof is respectively extended with a contact sheet; a retaining seat having a first retaining slot and a tongue sheet; an electrode sheet base having a pivotal shaft, one side of the pivotal shaft is formed with a positioning block, and one side of the pivotal shaft is received in the first retaining slot, two ends of the pivotal shaft are respectively installed with a switch seat, the switch seat is further formed with a seat hole, and the bottom of the seat hole is hollow; two electrode sheets, one end of each of the electrode sheets is formed with a stop sheet, the other end is formed with a wire hole, wherein the stop sheets are received in the seat holes and exposed outside the seat holes; and a bottom housing, able to be engaged with the top housing, having a hollow chamber for accommodating the retaining seat, a bottom housing surface is formed with two housing slots respectively allowing the two electrode sheets to be exposed, the bottom of the housing slot is hollow, and the end section is formed with a plane hole, a second retaining slot is formed between the two housing slots for receiving the other side of the pivotal shaft; after being assembled, when the two electrode sheets are longitudinally rotated, the two electrode sheets are enable to be pivotally moved at the outside of the bottom housing, and the two electrode sheets are positioned through the positioning block being in parallel with the tongue sheet, meanwhile the stop sheets of the two electrode sheets are in contact with the contact sheets, thereby electrically conducting the plural ring-shaped slots and the two electrode sheets.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
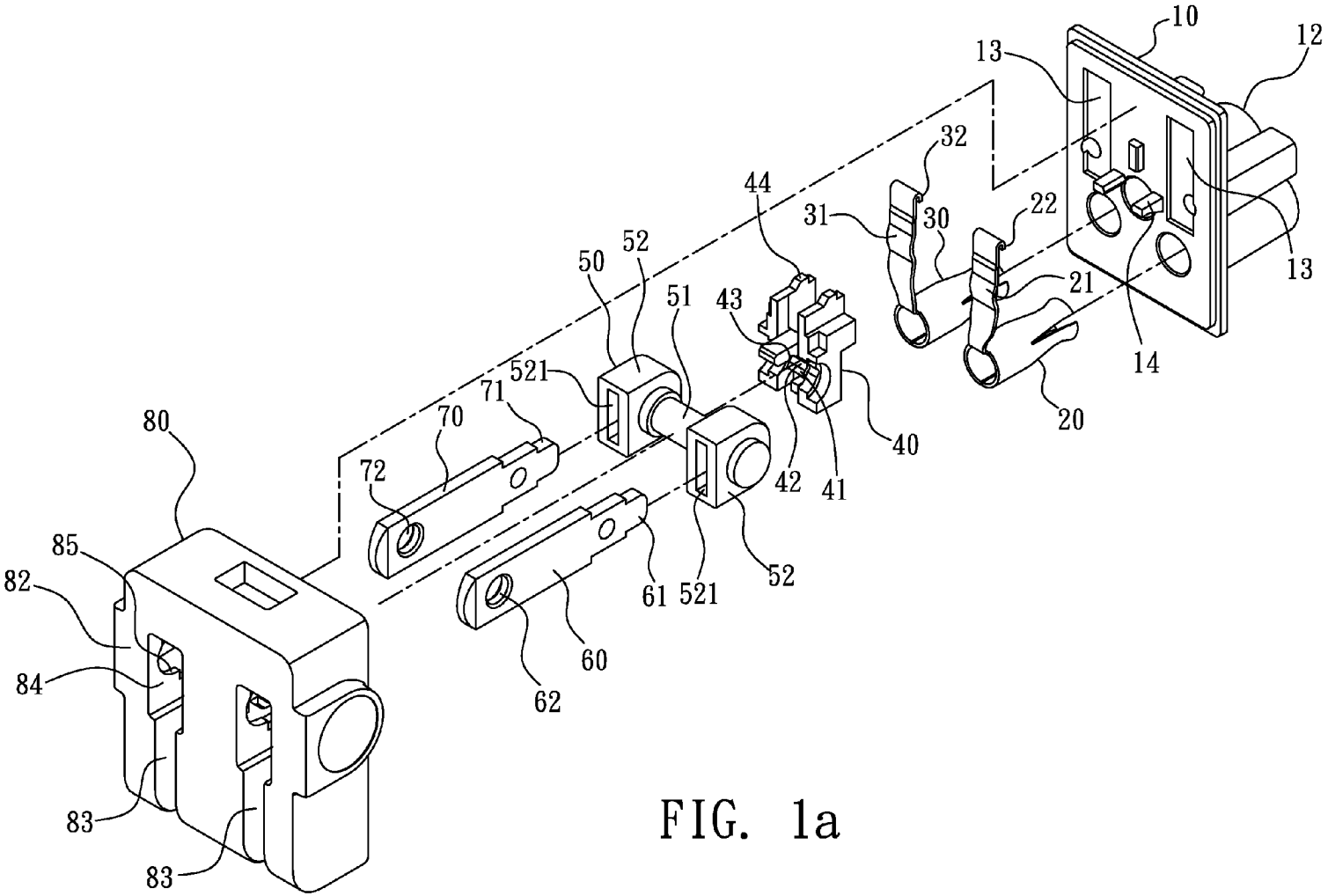
FIG. 1*a* is an exploded view illustrating the plug with connecting device according to one preferred embodiment of the present invention.
Figure 1B:
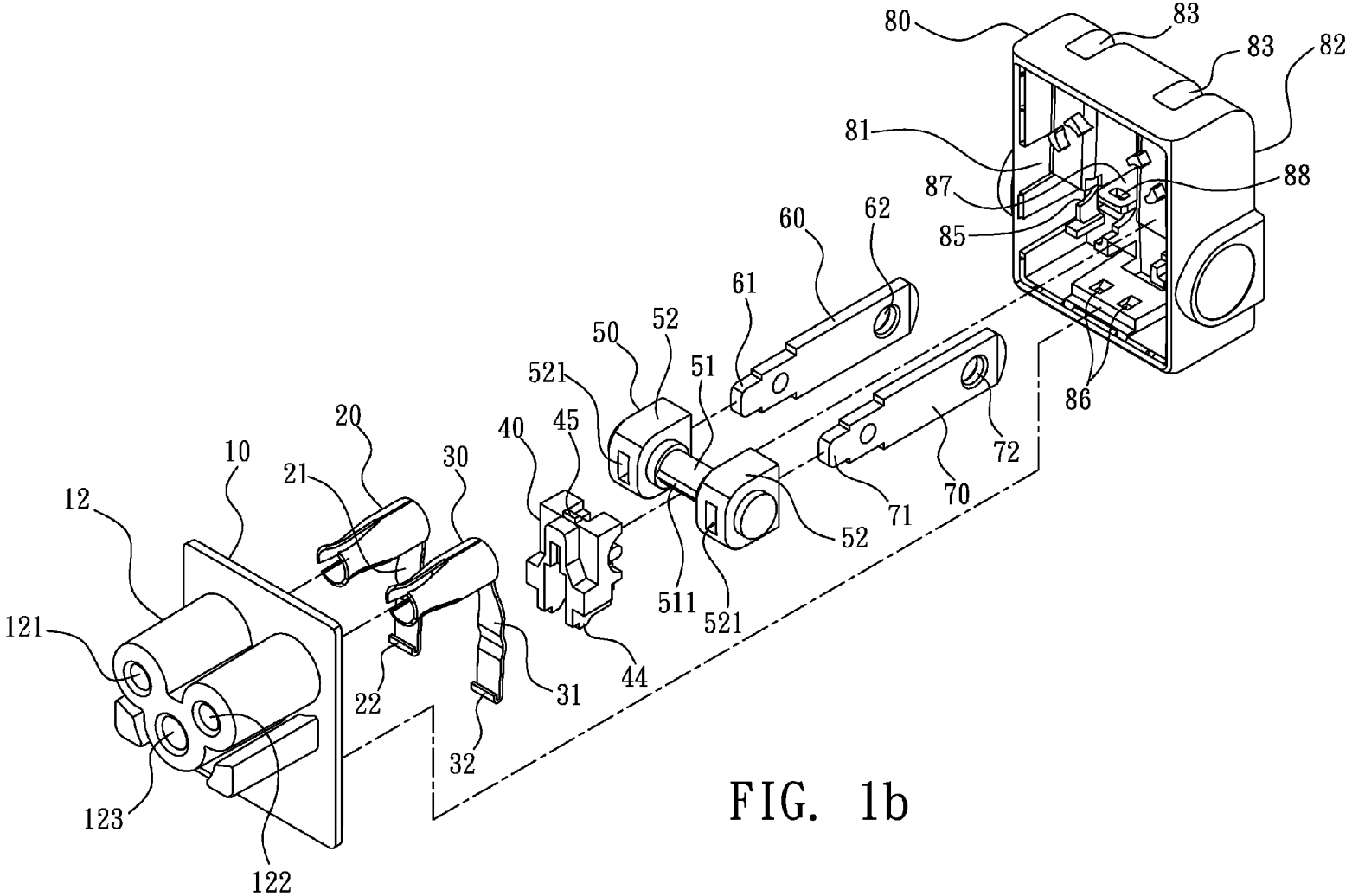
FIG. 1*b* is another exploded view illustrating the plug with connecting device according to one preferred embodiment of the present invention.
Figure 2:
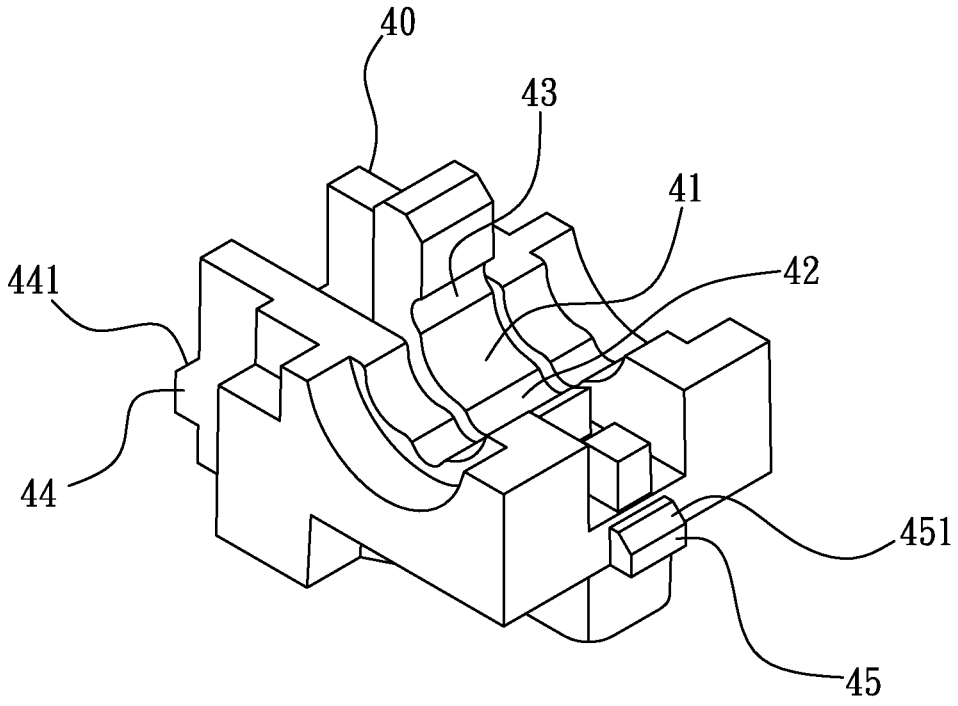
FIG. 2 is an enlarged view illustrating the retaining seat according to one preferred embodiment of the present invention.
Figure 3:
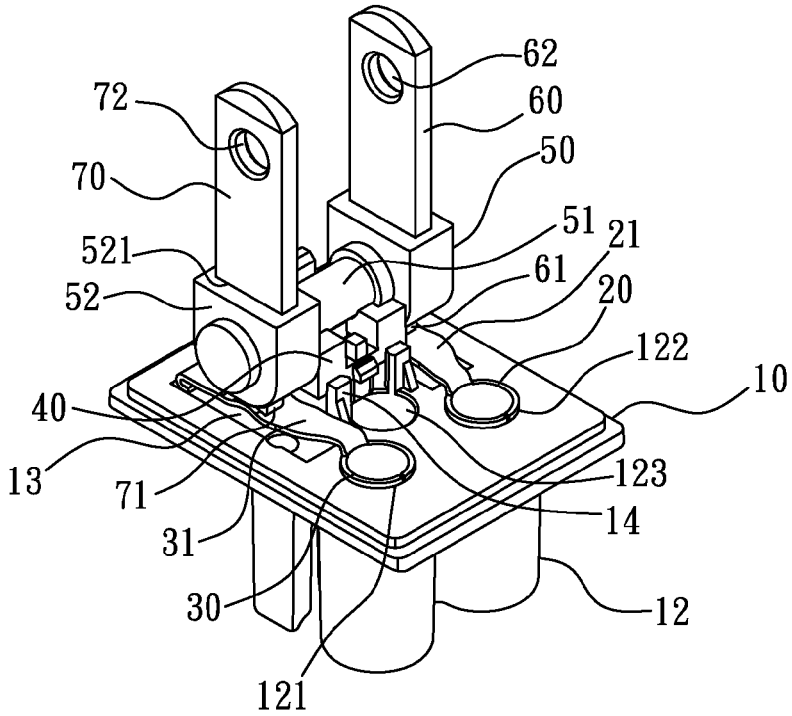
FIG. 3 is a schematic view illustrating the assembly of the top housing, the retaining seat, the electrode sheet base, the two electrode sheets and the two copper contact rings, according to one preferred embodiment of the present invention.
Figure 4:
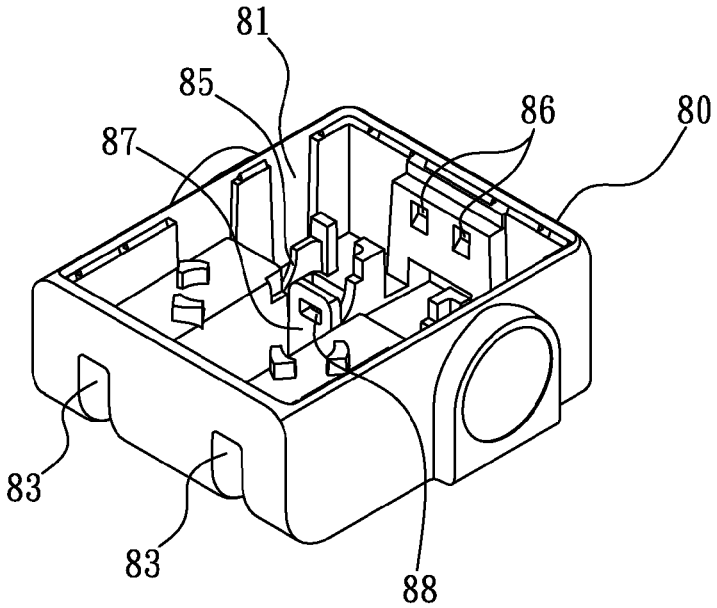
FIG. 4 is a schematic view illustrating the bottom housing according to one preferred embodiment of the present invention.
Figure 5A:
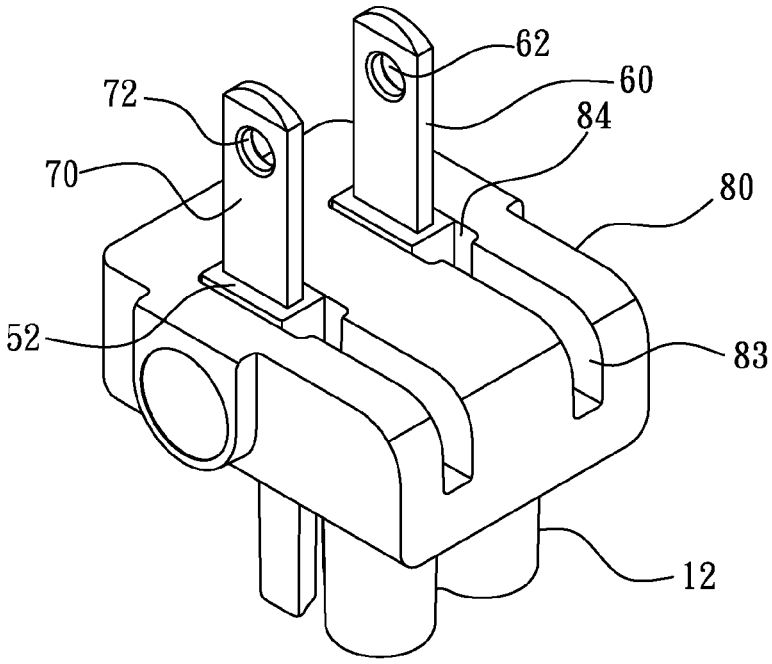
FIG. 5*a* is a schematic view illustrating the electrode sheets being extended outside the bottom housing after the plug with connecting device being assembled, according to one preferred embodiment of the present invention.
Figure 5B:
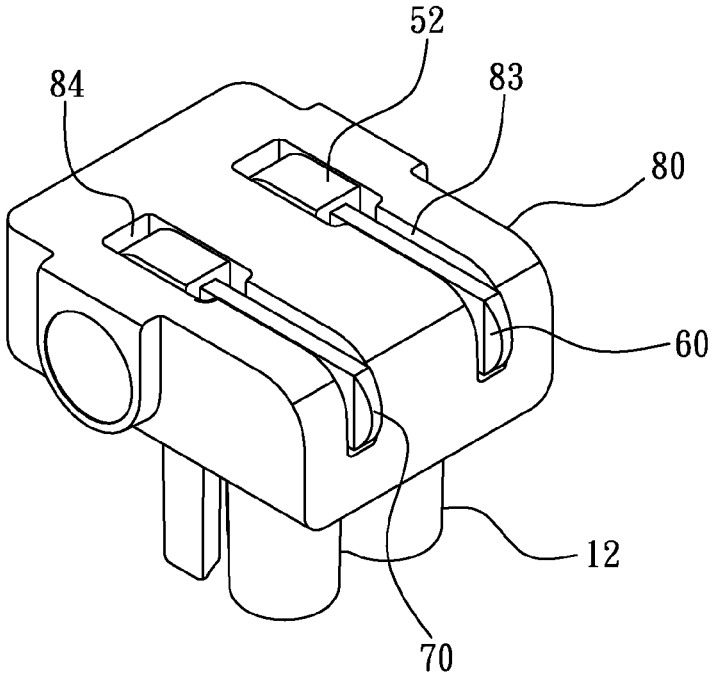
FIG. 5*b* is a schematic view illustrating the electrode sheets being folded into the bottom housing after the plug with connecting device being assembled, according to one preferred embodiment of the present invention.
Figure 6A:
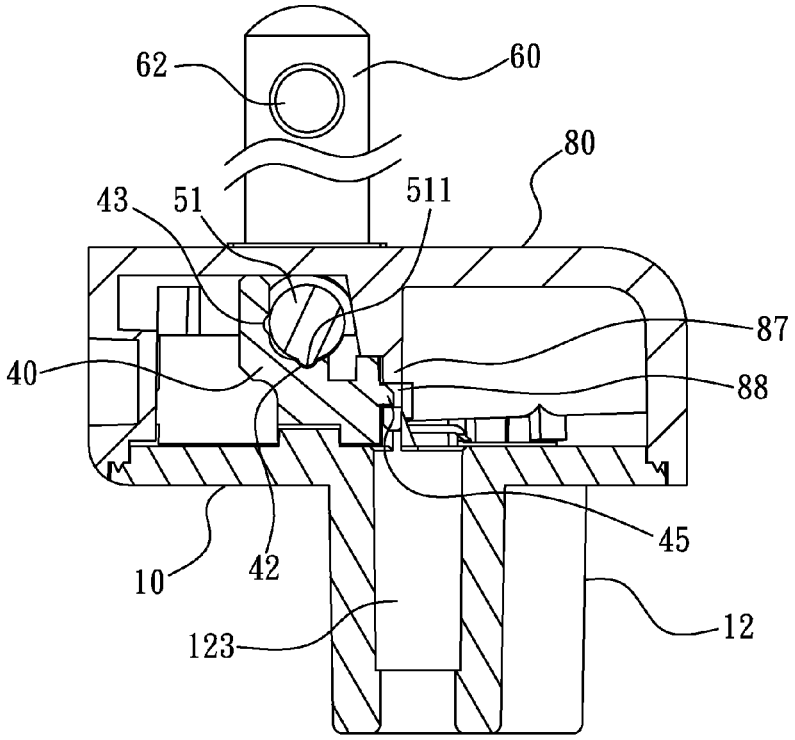
FIG. 6*a* is a cross sectional view illustrating the assembled plug with connecting device according to one preferred embodiment of the present invention.
Figure 6B:
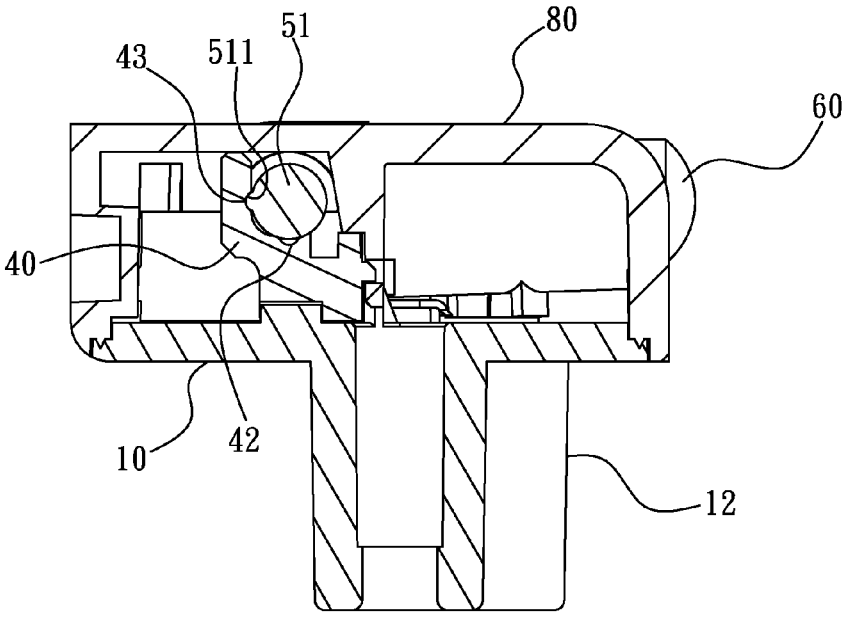
FIG. 6*b* is another cross sectional view illustrating the assembled plug with connecting device according to one preferred embodiment of the present invention.

Referring from FIG. 1*a* to FIG. 6*b*, wherein FIG. 1*a* is an exploded view showing the plug with connecting device according to one preferred embodiment of the present invention; FIG. 1*b* is another exploded view showing the plug with connecting device according to one preferred embodiment of the present invention; FIG. 2 is an enlarged view showing the retaining seat according to one preferred embodiment of the present invention; FIG. 3 is a schematic view illustrating the assembly of the top housing, the retaining seat, the electrode sheet base, the two electrode sheets and the two copper contact rings, according to one preferred embodiment of the present invention. FIG. 4 is a schematic view showing the bottom housing according to one preferred embodiment of the present invention; FIG. 5*a* is a schematic view illustrating the electrode sheets being extended outside the bottom housing after the plug with connecting device being assembled, according to one preferred embodiment of the present invention; FIG. 5*b* is a schematic view illustrating the electrode sheets being folded into the bottom housing after the plug with connecting device being assembled, according to one preferred embodiment of the present invention; FIG. 6*a* is a cross sectional view showing the assembled plug with connecting device according to one preferred embodiment of the present invention; and FIG. 6*b* is another cross sectional view showing the assembled plug with connecting device according to one preferred embodiment of the present invention.

As shown in figures, the plug with connecting device provided by the present invention, capable of being adopted in a portable electronic device, e.g. but not limited to a notebook computer or mini notebook computer, includes: a top housing 10; two copper contact rings 20, 30; a retaining seat 40; an electrode sheet base 50; two electrode sheets 60, 70; and a bottom housing 80.

The top housing 10 is extended with a connecting device 12 at one side, thereby being enabled to be connected to a power adopter (not shown in figures), the connecting device 12 has three ring-shaped slots, 121, 122, 123, and the connecting device 12 is e.g. but not limited to a socket having a contour defined by three arcs. In addition, the bottom of the top housing 10 is further formed with two sheet slots 13. Moreover, the bottom of the top housing 10 is formed with two positioning blocks 14 disposed between the two sheet slots 13 for positioning the retaining seat 40.

One end of each of the copper contact rings 20, 30 is in a gradually-expanding shape and is respectively received in the ring-shaped slots 121, 122 of the connecting device 12 and the other end thereof is respectively extended with a contact sheet 21, 31, the contact sheets 21, 31 are respectively received in the sheet slots 13 and one end section of each of the contact sheets 21, 31 respectively has a reverse hook 22, 32 respectively disposed at the end sections of the sheet slots 13.

The retraining seat 40 has a first retaining slot 41 formed in an e.g. but not limited to arc shape. In addition, the bottom of the first retaining slot 41 has a first positing slot 42, and the top of the first retaining slot 41 has a second positioning slot 43. Moreover, as shown in FIG. 2, the top of the retaining seat 40 is further formed with two first protrusions 44, the bottom thereof is formed with a second protrusion 45, the fronts of the two first protrusions 44 are respectively formed with an inclined surface 441, the front of the second protrusion 45 is also formed with an inclined surface 451.

The electrode sheet base 50 is installed with a pivotal shaft 51 formed in an e.g. but not limited to round shape, one side thereof is received in the first retaining slot 41, two ends of the pivotal shaft 51 are respectively installed with a switch seat 52 having a seat hole 521 therein, the bottom of the seat hole 521 is hollow, and the seat holes 521 are served to respectively receive the electrode sheets 60, 70. In addition, one side of the pivotal shaft 51 is installed with a positioning column 511 which can be respectively latched in the first positioning slot 42 or the second positioning slot 43.

One end of each of the two electrode sheets 60, 70 is respectively formed with a stop sheet 61, 71 and the other end thereof is respectively formed with a wire hole 62, 72, wherein the stop sheets 61, 71 are received in the seat holes 521 and exposed outside the seat holes 521.

The bottom housing 80 is able to be engaged with the top housing 10, and is formed with a hollow chamber 81 for accommodating the retaining seat 40, and a bottom housing surface 82 is formed with two housing slots 83, the bottom of the housing slot 83 is hollow, and one end section is formed with a plane hole 84 having a width larger than the housing slot 83, thereby allowing the switch seats 52 to be received and the electrode sheets 60, 70 to be exposed. A second retaining slot 85 is formed between the two housing slots 83, the shape of the second retaining slot 85 is e.g. but not limited to semicircle thereby fastening the other side of the pivotal shaft 51. The top housing 10 and the bottom housing 80 are made of an insulation material, e.g. but not limited to plastic. In addition, the bottom housing 80 is further formed with two recessed slots 86 corresponding to the first protrusions 44 thereby allowing the first protrusions 44 to be latched therein, such that the retaining seat 40 is able to be fastened in the bottom housing 80.

Moreover, the bottom housing 80 is further provided with a tongue sheet 87 disposed at one side of the second retaining slot 58, and the end section of the tongue sheet 87 is formed with a buckling hole 88 corresponding to the second protrusion 45 thereby allow the second protrusion 45 to be accommodated, so as to fasten the retaining seat 40.

As shown in FIG. 3, when being assembled, the two copper contact rings 20, 30 are respectively sleeved with the two ring-shaped slots 121, 122, thereby allowing the contact sheets 21, 31 to be received in the sheet slots 13; the retaining seat 40 is disposed in the top housing 10 and fastened through the two positioning blocks 14; the pivotal shaft 51 of the electrode sheet base 50 is installed in the first retaining slot 41 for being positioned and fastened; then the two electrode sheets 60, 70 are respectively disposed in the seat holes 521, so the stop sheets 61, 71 are respectively abutted against the contact sheets 21, 31, thereby fastening the electrode sheet base 50 and the electrode sheets 60, 70 in the top housing 10.

As shown in FIG. 4, the bottom housing 80 is engaged with the top housing 10, so the other side of the pivotal shaft 51 of the electrode sheet base 50 is enabled to be received in the second retaining slot 85, and the two first protrusions 44 are utilized to respectively buckle the two recessed slots 86, the second protrusion 45 is utilized to buckle the buckling hole 88 for the purpose of positioning and fastening, such that the two electrode sheets 60, 70 are partially exposed outside the housing slots 83, and the two electrode sheets 60, 70 are outwardly pushed for allowing the two electrode sheets 60, 70 to be respectively accommodated in the plane holes 84, and the positioning column 511 is latched in the first positioning slot 42 for being positioned, thereby allowing the stop sheets 61, 71 of the two electrode sheets 60, 70 to respectively be in contact with the contact sheets 21, 31, so the assembly of the plug with connecting device provided by the present invention is finished. After the assembly of the plug with connecting device provided by the present invention is finished, the connecting device 12 is connected to a power adapter (not shown in figures), an AC power source is therefore transferred to the power adapter through the copper contact rings 20, 30.

As shown in FIG. 5*a* and FIG. 6*a*, when being used, the two electrode sheets 60, 70 are outwardly pushed for being received in the plane holes 84 along the housing slots 83, the positioning column 511 is latched in the first positioning slot 42 for being positioned, the stop sheets 61, 71 of the two electrode sheets 60, 70 are respectively in contact with the contact sheets 21, 31, thereby forming an power supplying state.

As shown in FIG. 5*b* and FIG. 6*b*, when being folded, the two electrode sheets 60, 70 are inwardly pushed for being folded into the bottom housing 80 along the housing slots 83 and the plane holes 84, at this moment, the positioning column 511 is latched in the second positioning slot 43, and the two electrode sheets 60, 70 are aligned with the housing slots 83 to achieve the purpose of convenient storage, thus the stop sheets 61, 71 of the two electrode sheets 60, 70 are released from the contact sheets 21, 31, thereby terminating the power supplying state.

Figure 7A:
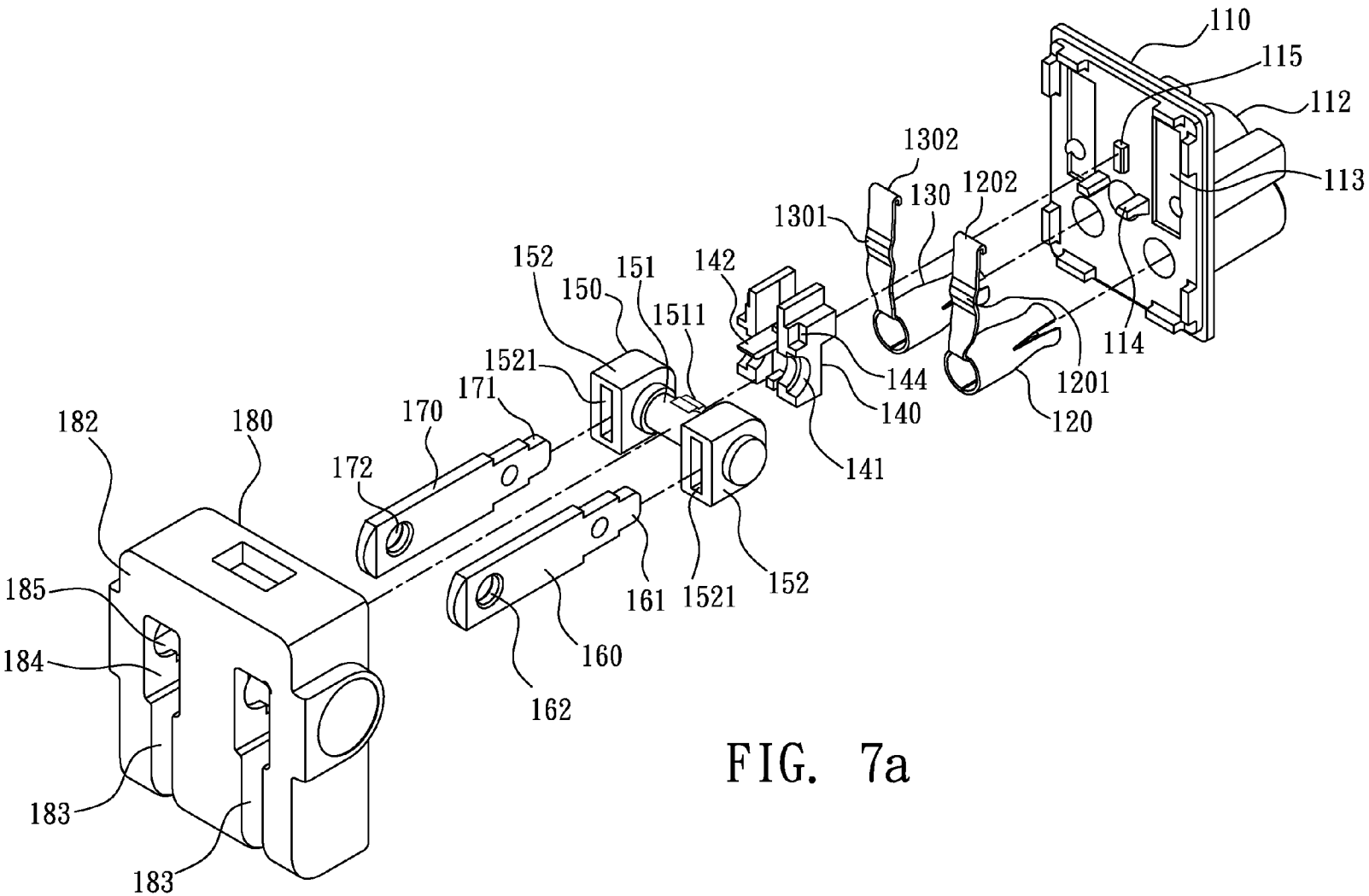
FIG. 7*a* is an exploded view illustrating the plug with connecting device according to another preferred embodiment of the present invention.
Figure 7B:
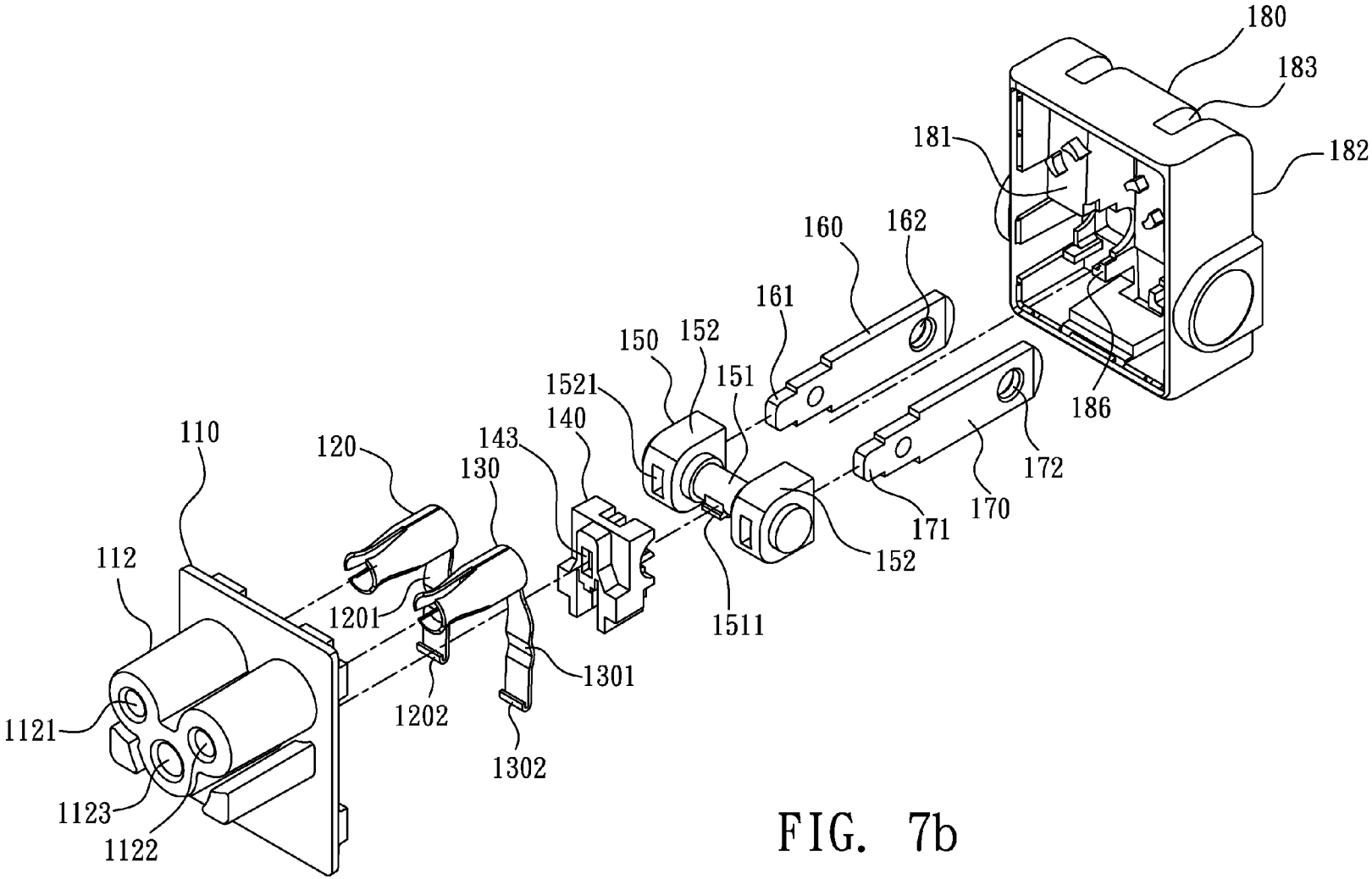
FIG. 7*b* is another exploded view illustrating the plug with connecting device according to another preferred embodiment of the present invention.
Figure 8:
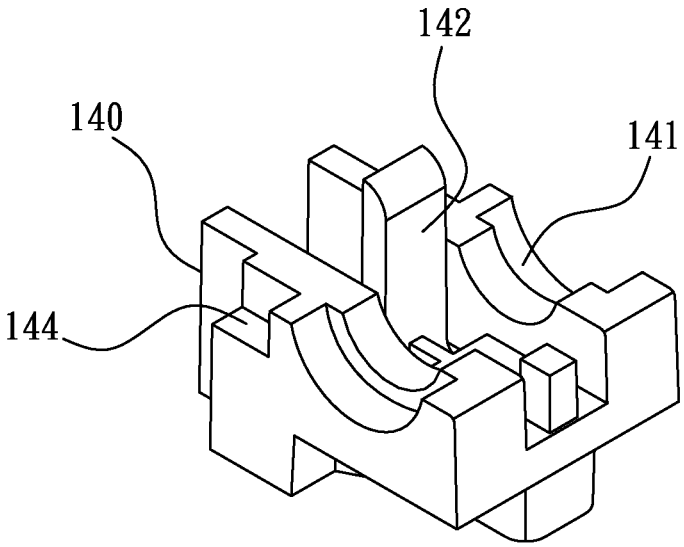
FIG. 8 is an enlarged view illustrating the retaining seat according to another preferred embodiment of the present invention.
Figure 9A:
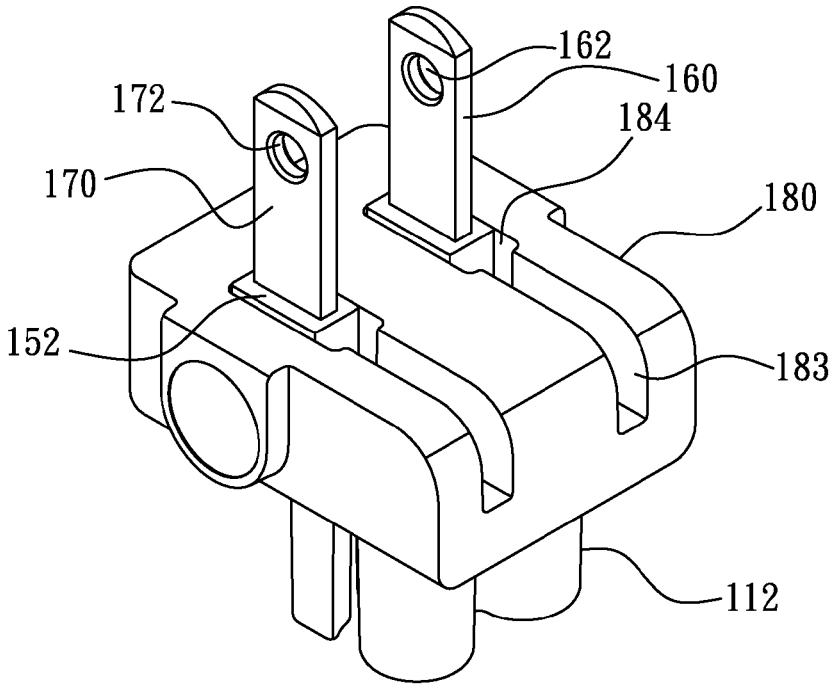
FIG. 9*a* is a schematic view illustrating the electrode sheets being extended outside the bottom housing after the plug with connecting device being assembled, according to another preferred embodiment of the present invention.
Figure 9B:
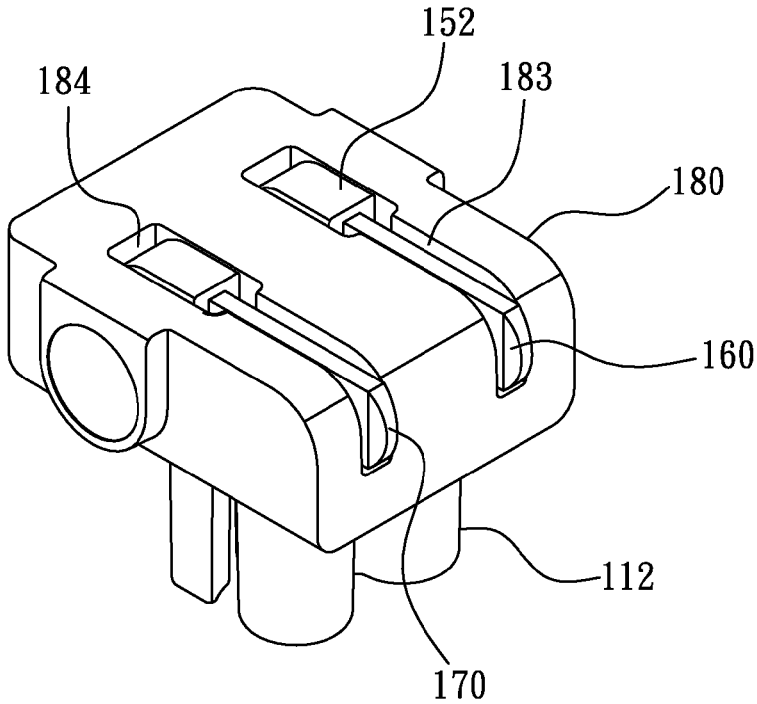
FIG. 9*b* is a schematic view illustrating the electrode sheets being folded into the bottom housing after the plug with connecting device being assembled, according to another preferred embodiment of the present invention.
Figure 10A:
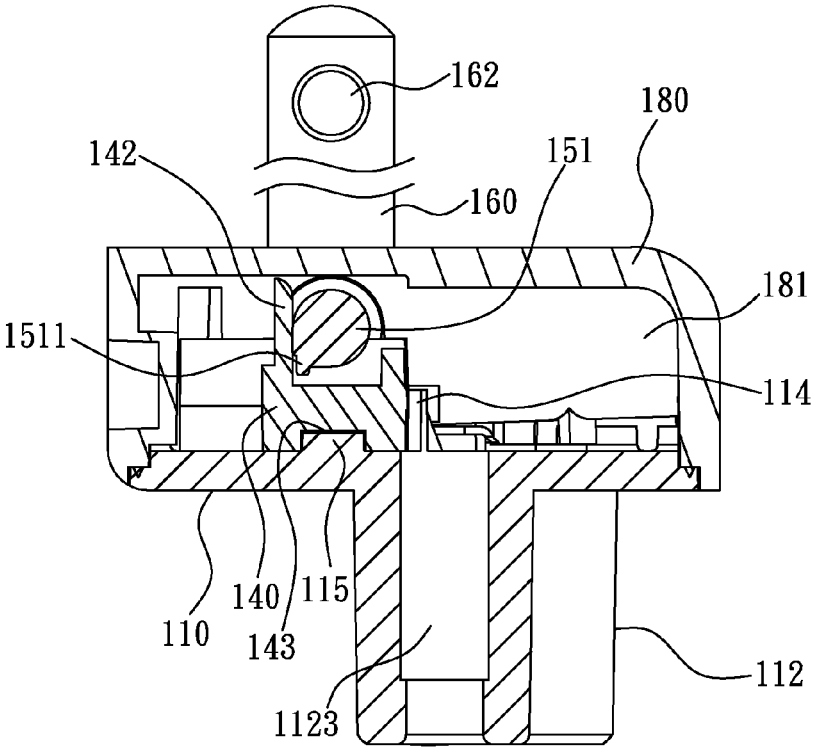
FIG. 10*a* is a cross sectional view illustrating the assembled plug with connecting device according to another preferred embodiment of the present invention.
Figure 10B:
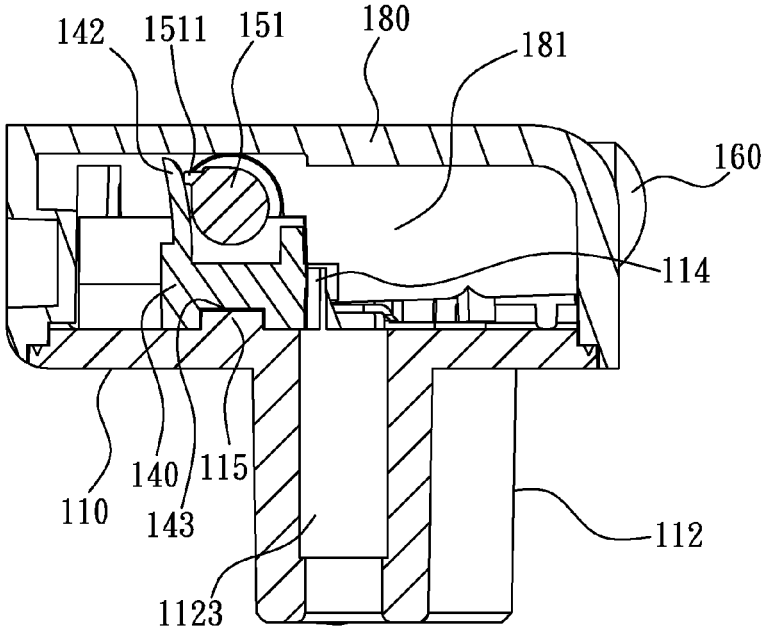
FIG. 10*b* is another cross sectional view illustrating the assembled plug with connecting device according to another preferred embodiment of the present invention.

Referring from FIG. 7*a* to FIG. 10*b*, wherein FIG. 7*a* is an exploded view showing the plug with connecting device according to another preferred embodiment of the present invention; FIG. 7*b* is another exploded view showing the plug with connecting device according to another preferred embodiment of the present invention; FIG. 8 is an enlarged view showing the retaining seat according to another preferred embodiment of the present invention; FIG. 9*a* is a schematic view illustrating the electrode sheets being extended outside the bottom housing after the plug with connecting device being assembled, according to another preferred embodiment of the present invention; FIG. 9*b* is a schematic view illustrating the electrode sheets being folded into the bottom housing after the plug with connecting device being assembled, according to another preferred embodiment of the present invention; FIG. 10*a* is a cross sectional view showing the assembled plug with connecting device according to another preferred embodiment of the present invention; and FIG. 10*b* is another cross sectional view showing the assembled plug with connecting device according to another preferred embodiment of the present invention.

As shown in figures, the plug with connecting device provided by the present invention, capable of being adopted in a portable electronic device, e.g. but not limited to a notebook computer or mini notebook computer, includes: a top housing 110; two copper contact rings 120, 130; a retaining seat 140; an electrode sheet base 150; two electrode sheets 160, 170; and a bottom housing 180.

The top housing 110 is extended with a connecting device 112 at one side, thereby being enabled to be connected to a power adopter (not shown in figures), the connecting device 112 has three ring-shaped slots, 1121, 1122, 1123, and the connecting device 112 is e.g. but not limited to a socket having a contour defined by three arcs. In addition, the bottom of the top housing 110 is further formed with two sheet slots 113. Moreover, the bottom of the top housing 110 is formed with two positioning blocks 114 disposed between the two sheet slots 113 for positioning the retaining seat 140. Moreover, a first protrusion 115 is formed between the two sheet slots 113.

One end of each of the copper contact rings 120, 130 is in a gradually-expanding shape and is respectively received in the ring-shaped slots 1121, 1122 of the connecting device 112 and the other end thereof is respectively extended with a contact sheet 1201, 1301, the contact sheets 1201, 1301 are respectively received in the sheet slots 113, and one end section of each of the contact sheets 1201, 1301 respectively has a reverse hook 1202, 1302 respectively disposed at the end sections of the sheet slots 113.

The retraining seat 140 has a first retaining slot 141 formed in an e.g. but not limited to arc shape. In addition, the top of the first retaining slot 141 is provided with a tongue sheet 142. The top of the retaining seat 140 is further formed with a first positioning slot 143, two ends of the first positioning slot 143 are respectively formed with a second positioning slot 144, wherein the first positioning slot 143 allows the first protrusion 115 to be latched therein, thereby fastening the retaining seat 140 in the top housing 110.

The electrode sheet base 150 is installed with a pivotal shaft 151 formed in an e.g. but not limited to round shape, one side thereof is received in the first retaining slot 141, two ends of the pivotal shaft 151 are respectively installed with a switch seat 152 having a seat hole 1521 therein, the bottom of the seat hole 1521 is hollow, and the seat holes 1521 are served to respectively receive the electrode sheets 160, 170. In addition, one side of the pivotal shaft 151 is installed with a positioning block 1511 capable of being abutted against the tongue sheet 142.

One end of each of the two electrode sheets 160, 170 is respectively formed with a stop sheet 161, 171 and the other end thereof is respectively formed with a wire hole 162, 172, wherein the stop sheets 161, 171 are received in the seat holes 1521 and exposed outside the seat holes 1521.

The bottom housing 180 is able to be engaged with the top housing 110, and is formed with a hollow chamber 181 for accommodating the retaining seat 140, and a bottom housing surface 182 is formed with two housing slots 183, the bottom of the housing slot 183 is hollow, and one end section is formed with a plane hole 184 having a width larger than the housing slot 183, thereby allowing the switch seats 152 to be received and the electrode sheets 160, 170 to be exposed. A second retaining slot 185 is formed between the two housing slots 183, the shape of the second retaining slot 185 is e.g. but not limited to semicircle thereby fastening the other side of the pivotal shaft 151. The top housing 110 and the bottom housing 180 are made of an insulation material, e.g. but not limited to plastic. In addition, two ends of the second retaining slot 185 are respectively formed with a second protrusion 186 capable of being respectively latched in the second positioning slot 144, thereby fastening the retaining seat 140 in the bottom housing 180.

When being assembled, the two copper contact rings 120, 130 are respectively sleeved with the two ring-shaped slots 1121, 1122, thereby allowing the contact sheets 1201, 1301 to be received in the sheet slots 113; the retaining seat 140 is disposed in the top housing 110 and fastened through the two positioning blocks 114; the pivotal shaft 151 of the electrode sheet base 150 is installed in the first retaining slot 141 for being positioned and fastened; then the two electrode sheets 160, 170 are respectively disposed in the seat holes 1521, thereby fastening the electrode sheet base 150 and the electrode sheets 160, 170 in the top housing 110.

The bottom housing 180 is engaged with the top housing 110, so the other side of the pivotal shaft 151 of the electrode sheet base 150 is enabled to be received in the second retaining slot 185, and the first positioning slot 143 is latched at the first protrusion 115, the second protrusions 186 are respectively latched in the second positioning slot 144 for the purpose of positioning and fastening, such that the two electrode sheets 160, 170 are partially exposed outside the housing slots 183, and the two electrode sheets 160, 170 are outwardly pushed for allowing the two electrode sheets 160, 170 to be respectively accommodated in the plane holes 184, and the positioning block 1511 is located at the bottom of the tongue sheet 142 for achieving the positioning purpose, thus the stop sheets 161, 171 of the two electrode sheets 160, 170 are respectively in contact with the contact sheets 1201, 1301, so the assembly of the plug with connecting device provided by the present invention is finished. After the assembly of the plug with connecting device provided by the present invention is finished, the connecting device 112 is connected to a power adapter (not shown in figures), an AC power source is therefore transferred to the power adapter through the copper contact rings 120, 130.

As shown in FIG. 9*a* and FIG. 10*a*, when being used, the two electrode sheets 160, 170 are outwardly pushed for being received in the plane holes 184 along the housing slots 183, and the positioning block 1511 is able to be in parallel at the bottom of the tongue sheet 142 for achieving the positioning purpose, thus the stop sheets 161, 171 of the two electrode sheets 160, 170 are respectively in contact with the contact sheets 1201, 1301, thereby forming an power supplying state.

As shown in FIG. 9*b* and FIG. 10*b*, when being folded, the two electrode sheets 160, 170 are inwardly pushed for being folded into the bottom housing 180 along the housing slots 183 and the plane holes 184, at this moment, the positioning block 1511 abuts at the bottom of the tongue sheet 142 and continuously applies forces for overcoming the resistant force of the tongue sheet 142, such that the positioning block 1511 is enabled to push aside the tongue sheet 142 for being positioned at the top of the tongue sheet 142, thus the two electrode sheets 160, 170 are aligned with the housing slots 183 to achieve the purpose of convenient storage, thus the stop sheets 161, 171 of the two electrode sheets 160, 170 are released from the contact sheets 1201, 1301, thereby terminating the power supplying state.

According to the plug with connecting device provided by the present invention, one end thereof can be connected to an AC power source through electrode sheets and the other end thereof can be coupled to a power adapter through the connecting device, and the converted DC power can be supplied to an electronic device; and the electrode sheets thereof are able to be folded into the bottom housing thereby terminating the electrical connection to AC power source. As such, the present invention is novel and more practical in use when comparing to a conventional power adapter.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A plug with connecting device, comprising:

a top housing having two bottom sheet slots and a connecting device extended from one side of the top housing for being connected to a power adapter, and said connecting device having plural ring-shaped slots;

two copper contact rings, wherein one end of each of said copper contact rings being in a gradually-expanding shape and respectively received in said ring-shaped slots of said connecting device, the other end thereof being respectively a contact sheet extended perpendicular from the expanding shape, the contact sheets being received in the two bottom sheet slots;

a retaining seat having a first retaining slot, a bottom of said first retaining slot being formed with a first positioning slot, a top of said first retaining slot being formed with a second positioning slot;

an electrode sheet base having a pivotal shaft, one side of said pivotal shaft being formed with a positioning column, and one side of said pivotal shaft being received in said first retaining slot, two ends of said pivotal shaft being respectively installed with a switch seat, said switch seat being further formed with a seat hole, and the bottom of said seat hole being hollow;

two electrode sheets, one end of each of said electrode sheets being formed with a stop sheet, the other end being formed with a wire hole, wherein said stop sheets being received in said seat holes and exposed outside said seat holes; and a bottom housing, capable to be engaged with said top housing, having a hollow chamber for accommodating said retaining seat, a bottom housing surface being formed with two housing slots respectively allowing said two electrode sheets to be exposed, the bottom of said housing slot being hollow, and the end section being formed with a plane hole, a second retaining slot being formed between said two housing slots for receiving the other side of said pivotal shaft;

after being assembled, when said two electrode sheets being longitudinally rotated, said two electrode sheets are enable to be pivotally moved at the outside of said bottom housing, and said two electrode sheets being positioned through said positioning column being latched in said first positioning slot, meanwhile said stop sheets of said two electrode sheets being in contact with said contact sheets, thereby electrically conducting said plural ring-shaped slots and said two electrode sheets;

wherein the top of said retaining seat is further formed with two first protrusions, the bottom thereof is formed with a second protrusion, and the fronts of said first protrusions and said second protrusion are respectively formed with an inclined surface.

2. The plug with connecting device as claimed in claim 1, wherein said top housing and said bottom housing are made of an insulation material.

3. The plug with connecting device as claimed in claim 1, wherein said connecting device is a socket having a contour defined by three arcs.

4. The plug with connecting device as claimed in claim 1, wherein said bottom housing is further formed with two recessed slots allowing said two first protrusions to be latched thereby fastening said retaining seat.

5. The plug with connecting device as claimed in claim 1, wherein said bottom housing is further formed with a tongue sheet disposed at one side of said second retaining slot, and the end section of said tongue sheet is formed with a buckling hole allowing said second protrusion to be accommodated, thereby fastening said retaining seat.

6. The plug with connecting device as claimed in claim 1, wherein the width of said plane hole is larger than said housing slot.

7. The plug with connecting device as claimed in claim 1, wherein the bottom of said top housing is further formed with two sheet slots for receiving said copper contact rings.

8. The plug with connecting device as claimed in claim 7, wherein the bottom of said top housing is further formed with two positioning blocks for positioning said retaining seat.

9. A plug with connecting device, comprising:

a top housing having two bottom sheet slots and a connecting device extended from one side of the top housing for being connected to a power adapter, and said connecting device having plural ring-shaped slots;

two copper contact rings, wherein one end of each of said copper contact rings being in a gradually-expanding shape and respectively received in said ring-shaped slots of said connecting device, the other end thereof being respectively a contact sheet extended perpendicular from the expanding shape, the contact sheets being received in the two bottom sheet slots;

a retaining seat having a first retaining slot and a tongue sheet;

an electrode sheet base having a pivotal shaft, one side of said pivotal shaft being formed with a positioning block, and one side of said pivotal shaft being received in said first retaining slot, two ends of said pivotal shaft being respectively installed with a switch seat, said switch seat being further formed with a seat hole, and the bottom of said seat hole being hollow;

two electrode sheets, one end of each of said electrode sheets being formed with a stop sheet, the other end being formed with a wire hole, wherein said stop sheets being received in said seat holes and exposed outside said seat holes; and a bottom housing, able to be engaged with said top housing, having a hollow chamber for accommodating said retaining seat, a bottom housing surface being formed with two housing slots respectively allowing said two electrode sheets to be exposed, the bottom of said housing slot being hollow, and the end section being formed with a plane hole, a second retaining slot being formed between said two housing slots for receiving the other side of said pivotal shaft;

after being assembled, when said two electrode sheets being longitudinally rotated, said two electrode sheets are enable to be pivotally moved at the outside of said bottom housing, and said two electrode sheets being positioned through said positioning block being in parallel with said tongue sheet, meanwhile said stop sheets of said two electrode sheets being in contact with said contact sheets, thereby electrically conducting said plural ring-shaped slots and said two electrode sheets;

wherein the to of said retaining seat is further formed with a first positioning slot, and two ends of said first positioning slot are respectively formed with a second positioning slot.

10. The plug with connecting device as claimed in claim 9, wherein said top housing and said bottom housing are made of an insulation material.

11. The plug with connecting device as claimed in claim 9, wherein said connecting device is a socket having a contour defined by three arcs.

12. The plug with connecting device as claimed in claim 1, wherein said top housing is further formed with a first protrusion corresponding to said first positioning slot, said first protrusion and said first positioning slot are mutually latched thereby fastening said retaining seat in said top housing.

13. The plug with connecting device as claimed in claim 1, wherein two ends of said second retaining slot are respectively formed with a second protrusion capable of being respectively latched in said second positioning slots, thereby fastening said retaining seat in said bottom housing.

14. The plug with connecting device as claimed in claim 9, wherein the width of said plane hole is larger than said housing slot.

15. The plug with connecting device as claimed in claim 9, wherein the bottom of said top housing is further formed with two sheet slots for receiving said copper contact rings.

16. The plug with connecting device as claimed in claim 15, wherein the bottom of said top housing is further formed with two positioning blocks for positioning said retaining seat.

* * * * *